US007967136B2

(12) United States Patent
Bryant, Jr.

(10) Patent No.: US 7,967,136 B2
(45) Date of Patent: Jun. 28, 2011

(54) SANITARY CASE

(76) Inventor: Kenneth E. Bryant, Jr., Fayetteville, NC (US)

( * ) Notice: Subject to any disclaimer, the term of this patent is extended or adjusted under 35 U.S.C. 154(b) by 154 days.

(21) Appl. No.: 12/248,921

(22) Filed: Oct. 10, 2008

(65) Prior Publication Data

US 2010/0089792 A1 Apr. 15, 2010

(51) Int. Cl.
*B65D 71/00* (2006.01)

(52) U.S. Cl. ..... 206/351; 206/234; 220/495.05

(58) Field of Classification Search ..... 206/234, 206/349, 351, 576, 581, 702; 132/212, 287; 211/26; 220/495.01–495.06, 23.9
See application file for complete search history.

(56) References Cited

U.S. PATENT DOCUMENTS

| | | | | |
|---|---|---|---|---|
| 3,715,038 | A | 2/1973 | Winkler | |
| D244,720 | S | 6/1977 | Winkler | |
| 4,372,605 | A | 2/1983 | Cervantes | |
| 4,795,179 | A | 1/1989 | Liner | |
| 4,807,760 | A * | 2/1989 | Sussman | 206/581 |
| 5,875,794 | A * | 3/1999 | Ekman | 132/287 |
| 5,878,757 | A | 3/1999 | Hernandez | |
| 6,170,680 | B1 | 1/2001 | Hung | |
| 6,843,488 | B1 | 1/2005 | Tseng | |
| 7,140,372 | B2 * | 11/2006 | Byun | 132/287 |
| 2005/0224305 | A1 * | 10/2005 | Davis | 190/113 |
| 2007/0095720 | A1 * | 5/2007 | Barnett | 206/581 |
| 2008/0099033 | A1 | 5/2008 | Yeh | |

* cited by examiner

*Primary Examiner* — Luan K Bui
(74) *Attorney, Agent, or Firm* — The Parker Law Office, PLLC; DeLeon Parker, Jr.

(57) ABSTRACT

A sanitary case having a cavity defined by a bottom and perimeter wall extending upwardly from the bottom, at least one slot defined through the perimeter wall adjacent the bottom, and a liner disposed on the bottom. A plurality of upstanding dividers depending inwardly from the perimeter wall may define a plurality of cavities. The slot is adapted to receive the liner therethrough.

3 Claims, 6 Drawing Sheets

SANITARY CASE

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of Invention

This invention relates generally to carrying cases, caddies and trays adapted to facilitate cleaning, and more specifically relates to cases and trays used by barbers, hairstylists, and the like.

2. Description of the Related Art

In the past, barbers often carried their clippers, scissors and the like in a case. Tools might be kept in a suitcase or other carrying case for ease of portability. These cases served two functions: (1) transportation of barber implements, and (2) as a work area for barbers during use. However, as sanitation requirements have changed, barbers are often no longer able to carry their clippers and tools in cases that cannot be readily cleaned of hair and debris. Hair left in the case between trimmings accumulates over time. This accumulation of hair can be difficult to clean from the case and presents an unsanitary condition.

To meet changing requirements, barbers may place a towel in their suitcases in an attempt to catch falling hair from the clippers. The towel must be removed from the case before transporting the clippers. However, this option still leaves the case susceptible to sanitary problems since hair can accumulate in linings or corners of the case. Towels of cloth material placed in the case may not fit into dividers well, and hair is often dropped or transferred into the case when attempting to remove the towel for cleaning. Additionally, the cases are often not suited to sit on a counter, and often slide off. Some barbers resort to placing clippers and other implements on a counter. However, this sometimes leads to tools sliding off the counter when a barber brushes up against them. Such falls can, and often do, result in expensive damage to implements such as electric clippers.

Stationary trays have been developed to provide work and access areas for barbers. However, a device is needed that provides a portable sanitary work area for retaining barbershop implements that can be easily cleaned.

SUMMARY OF THE INVENTION

The present invention is directed to portable sanitary carrying cases and trays for barbers, hairstylists, and the like. The invention is further directed to a case that is easy to clean and ensures sanitary conditions between and after use. Some embodiments of the invention may further provide multiple cavities or compartments, and they may also be adapted to retain power cords of electrically operated implements. Embodiments of the device comprise a bottom having a perimeter wall extending upwardly therefrom and defining a cavity therein. The perimeter wall further comprises one or more end wall portions. A slot is defined through the perimeter wall adjacent the bottom. In some embodiments the slot may be defined through an end wall portion. The perimeter wall has connecting portions preferably having dividers depending therefrom. In some embodiments connecting portion pairs are oppositely disposed providing a plurality of cavities. Connecting portion pairs may be disposed on a first and second end wall portion in some embodiments. Dividers may be configured parallel to or perpendicular with the slot. A divider in a perpendicular configuration embodiment may extend downwardly to the top surface of the bottom. The perimeter wall further has a top rim with one or more cord slots to relieve stress on the electrical implement cord for implements placed within the case.

DESCRIPTION OF THE PREFERRED EMBODIMENT

Figure 1:
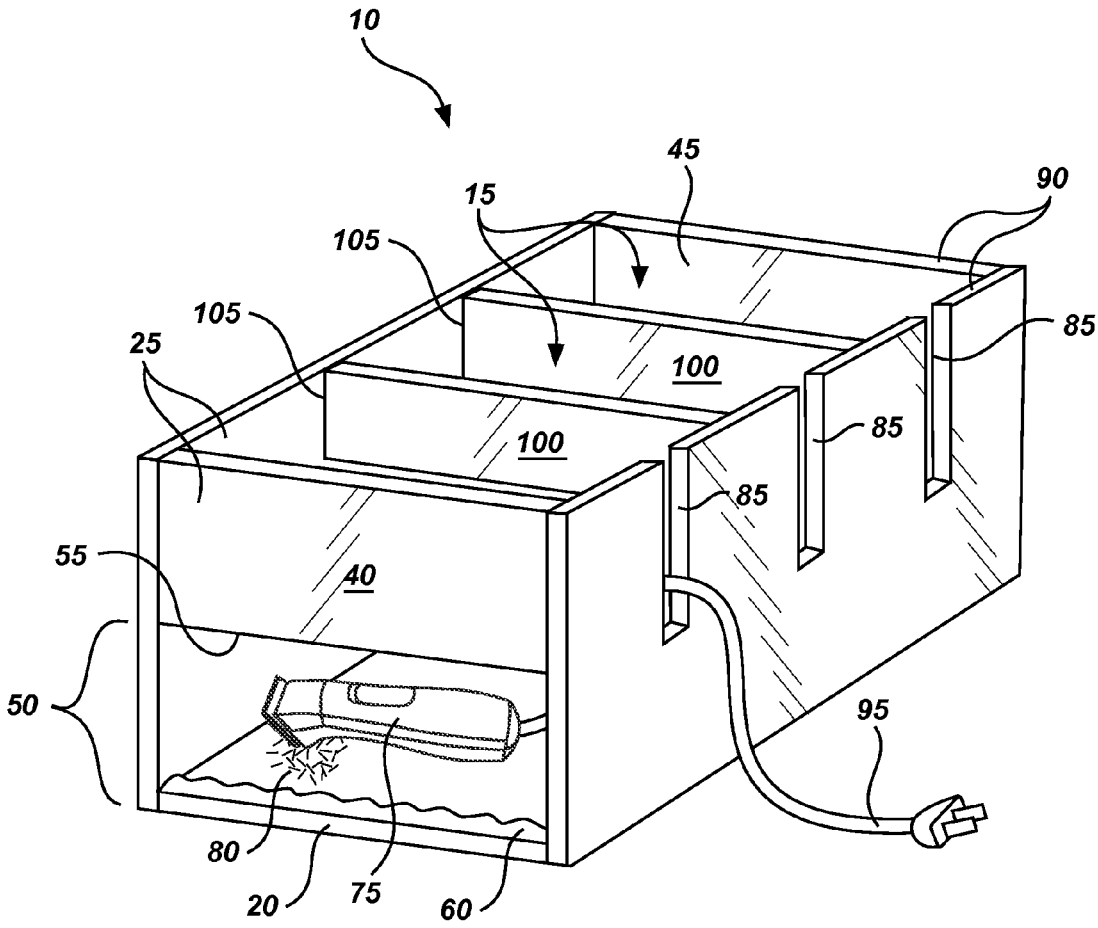
FIG. 1 is a perspective view of a tray as practiced in the current invention.
Figure 2:
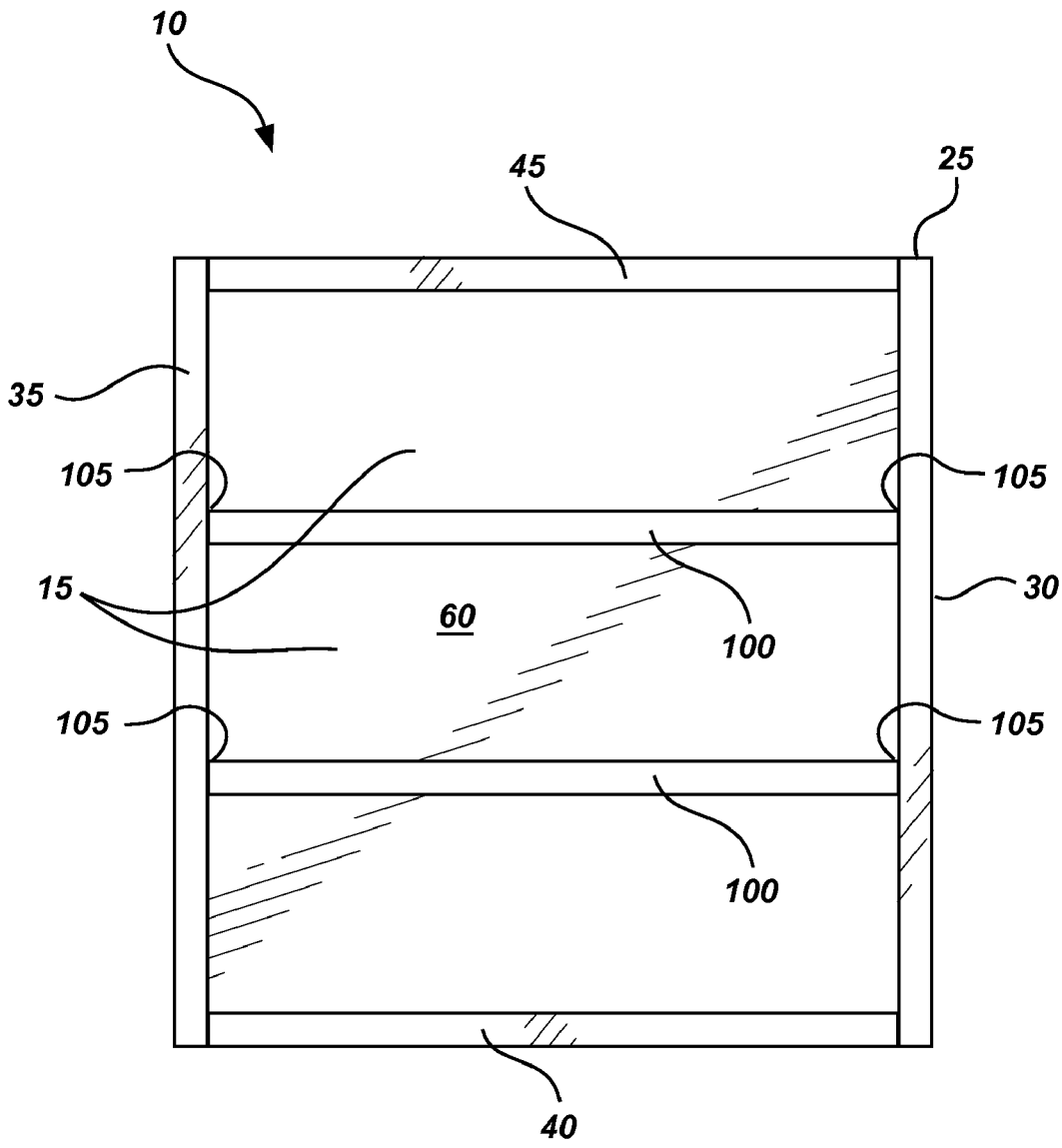
FIG. 2 is a plan view of a tray as practiced in the current invention.
Figure 3:
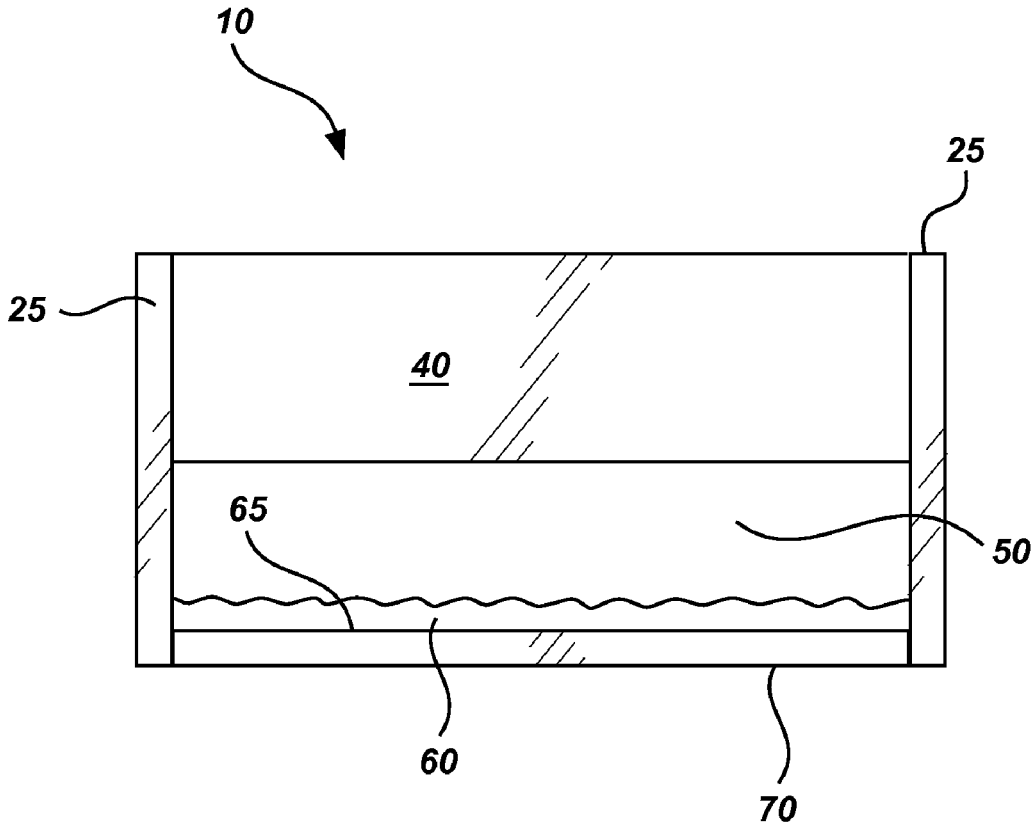
FIG. 3 is an elevation view of the end wall portions of a tray as practiced in the current invention.
Figure 4:
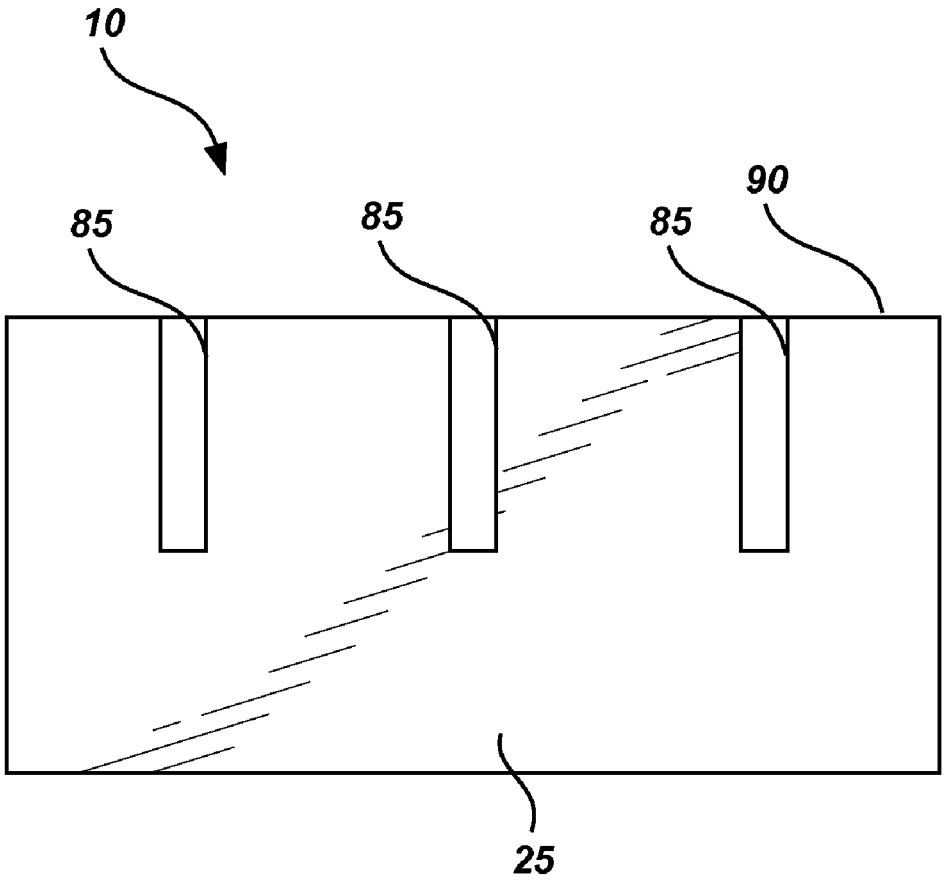
FIG. 4 is an elevation view of the perimeter wall first side as practiced in an embodiment of the current invention.

Referring now to the drawings in greater detail, FIG. 1-FIG. 4, a sanitary case 10 or tray for carrying or retaining hair-cutting implements 75 is disclosed. Case 10 and tray are used interchangeably herein. A bottom 20 and a perimeter wall 25 extending upwardly from the bottom 20 define a cavity 15. In the illustrated embodiment, the case 10 perimeter wall 25 comprises four sides and is rectangular. The perimeter wall 25 further comprises a first side 30 and a second side 35. The first side 30 and second side 35 are affixed to the bottom 20, and these sides 30, 35 are positioned opposite each other. The perimeter wall 25 is perpendicular to the bottom 20. However, in other embodiments it may be advantageous for the perimeter wall 25 to be angled either inwardly or outwardly from the bottom 20. The bottom 20 further has a top surface 65 defining the cavity 15 lower boundary, and a bottom surface 70. The bottom surface 70 is preferably adapted to provide friction resistance to movement. To accomplish this, a non-skid material may be attached to the bottom 20, impregnated into the bottom 20, or otherwise applied or incorporated into the bottom 20 in a manner that retains the non-skid means to the bottom surface 70.

In the illustrated embodiment, two opposing sides or ribs define a first end wall portion 40 and second end wall portion 45 of the perimeter wall 25. The first end wall portion 40 and second end wall portion 45 are positioned between the first side 30 and second side 35 providing support and rigidity. The end wall portions 40, 45 affix to the distal ends of the first side 30 and second side 35, and have a height dimension that is less than the height of the first side 30 and second side 35. The first end wall portion 40 and second end wall portion 45 are positioned along the first side 30 and second side 35 to define a hole or slot 50 beneath a lower edge 55 of the first end wall portion 40 and second end wall portion 45, above the bottom 20, and between the first side 30 and second side 35. A removable sanitary liner 60 lines the bottom 20 of the case 10. The slot 50 should be of sufficient height and width to allow easy insertion and removal of the sanitary liner 60 through the hole. Preferably, no hair or loose clippings 80 should fall from the liner 60 or transfer to the bottom 20 during removal. Thus, the slot 50 is preferably configured in a size and shape to facilitate easy sanitary liner 60 removal and minimize transfer of clippings 80 to the bottom 20.

In the illustrated embodiment, the liner 60 may be a terry-cloth towel. The towel provides a clean, soft work surface that retains hair cutting and styling tools and implements 75. As a barber uses these tools, small pieces of hair typically gather on the tools. As the tools are set aside between use, hair tends to dislodge and fall out of the tool. The liner 60 ensures that these loose clippings 80 do not drop into the case 10. Rather, clippings 80 fall onto the liner 60. At the end of a session or day, the barber can clean the implements 75 and remove the liner 60 through the slot 50. Removing the liner 60 effectively cleans the loose clippings 80 from the case 10. If the liner 60 is a towel as depicted, the liner 60 can be easily washed and a new liner 60 placed into the case 10. Other liners 60 may also be suitable provided that they are adapted to fit within the bottom 20 of the case 10, retain loose clippings 80 thereon, and can be easily removed from the case 10 without spilling or dropping loose clippings 80 from the sanitary liner 60 into the case 10. Liners 60 might be flexible and pliable, such as a towel or other cloth, paper, plastic, vinyl, foil, or other materials having like characteristics. In other embodiments, the liner 60 might be rigid or semi-rigid, form-fitting, and composed of materials such as wood, cardboard, hard plastic, metal, or the like.

The case 10 further has one or more cord slots 85 formed, notched or cut into the first side 30. Cord slots 85 extend downwardly from a top edge 90 of the first side 30 towards the bottom 20. The cord slot 85 is adapted to retain an electrical cord 95 of electrical clippers and implements 75. The cord slot 85 reduces stress on the cord 95 at the cord 95 attachment to the implement 75.

The case 10 may further have one or more dividers 100 as shown. As illustrated, each divider 100 depends from a connection portion 105 of the perimeter wall 25. Dividers 100 allow the case 10 to have multiple sections and cavities 15 separating different tools. As shown, these dividers 100 are similar in appearance to the first end wall portion 40 and second end wall portion 45. However, if the case 10 is configured differently the dividers 100 and end wall portions 40, 45 may have divergent shapes. The dividers 100 extend between the first side 30 and the second side 35 and have a height dimension that is less than the height of the first side 30 and second side 35. A slot 50 is defined below the divider 100, above the bottom 20, and between the first side 30 and second side 35. As shown, the dividers 100 are parallel to the end wall portions 40, 45 and perpendicular to the first side 30 and second side 35. Further, the slots 50 are axially aligned so the sanitary liner 60 is easily placed along the entire bottom 20 top surface 65 and can be flush with the first side 30 and second side 35.

Figure 5:
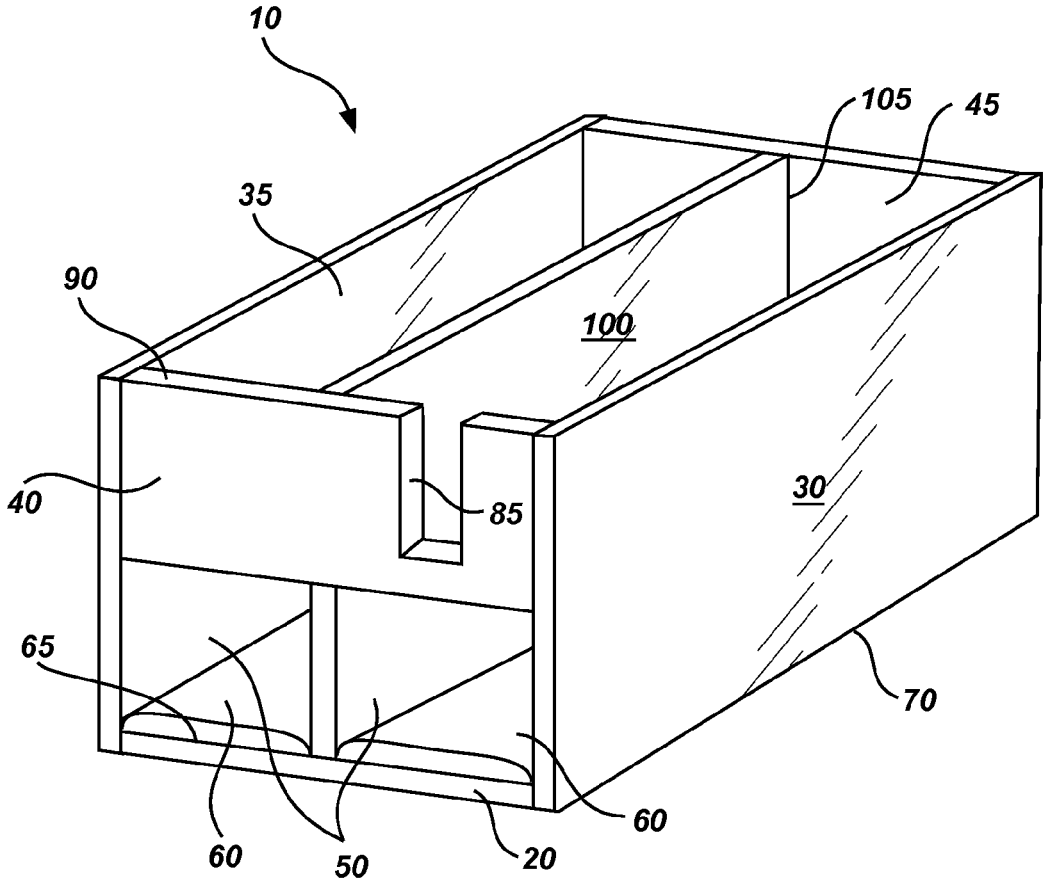
FIG. 5 is a view of an end wall portion of the tray as practiced in the current invention having dividers perpendicular to the perimeter wall slot.

In alternate embodiments, the dividers 100 might be oriented perpendicular to the slot 50 defined in the perimeter wall 25 as depicted in FIG. 5. If this arrangement is used, the dividers 100 might have a greater height dimension and might extend to, and be flush with or affixed to, the bottom 20. In this arrangement, a separate liner 60 would be placed in each section. Further, instead of one slot 50 defined on each side as shown in FIG. 1, multiple slots 50 would be defined in the first side 30 and second side 35 as shown in FIG. 5.

Figure 6:
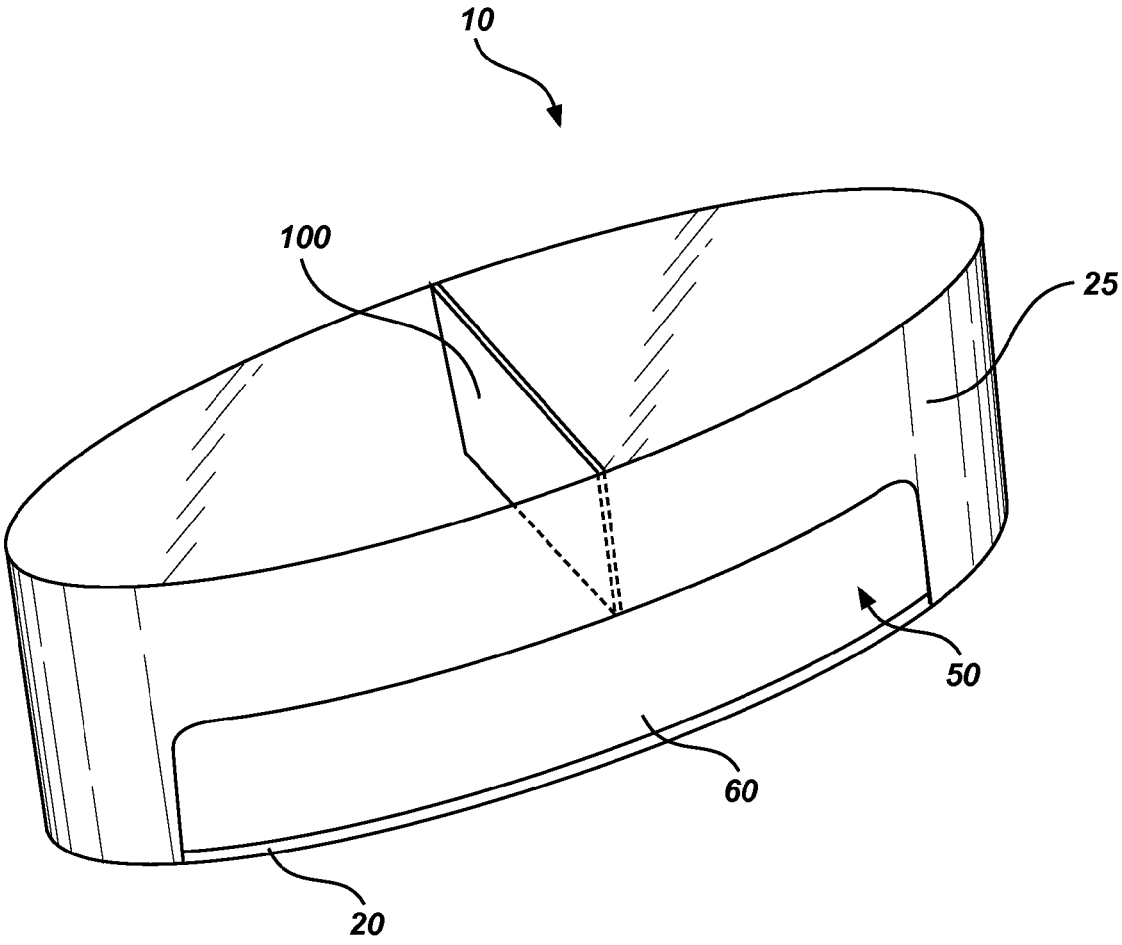
FIG. 6 is a perspective view of an alternate embodiment of a tray as practiced in the current invention.

FIG. 6 depicts an alternate embodiment of the present invention. In this embodiment, the device has a bottom 20. A unitary perimeter wall 25 extends upwardly from the periphery of the bottom 20. The perimeter wall 25 has a slot 50 defined therein. The slot 50 is adjacent the bottom 20. A towel is shown as the sanitary liner 60 that lines the bottom 20 of the case 10. The slot 50 is large enough to remove the liner 60 from the case 10 without dropping loose clippings 80 into the case 10 or directly onto the bottom 20. Dividers 100 may also be provided depending from connection portions 105 of the perimeter wall 25 as previously described. Dividers 100 may be oriented parallel with, or perpendicular to, the slot 50 as previously described. The case 10 in this embodiment may be molded as a unitary piece or constructed of separate pieces.

The case 10 depicted in FIG. 1-FIG. 5 and FIG. 6 may likewise be manufactured as a unitary piece from molded materials such as plastic. Alternately, the case 10 may be made from wood, metal, paperboard, plywood, particle board, or other similar materials using suitable construction techniques known in the art of tray and case 10 making. Dividers 100 may be glued in place, tacked, stapled, or otherwise affixed by known affixing means to the perimeter walls 25. In other embodiments, the dividers 100 may be removable or positionable so that cavities 15 of various sizes may be created.

Further variations may provide additional benefits. In the depicted embodiments, the bottom 20 is affixed to the perimeter wall 25. However, the bottom 20 may be removably attached to the sides. Any variety of latches, pins, coupling devices, or the like may be used to attach the perimeter walls 25 to the bottom 20. Further, the case 10 may have a top. A rigid top may be removably affixed to the case 10, or a soft cover may be placed on the top.

The case 10 may further have enclosed or external slots and handles to facilitate transporting the case 10.

As has been demonstrated, the present invention provides a case 10 or tray having a removable liner 60 providing a sanitary means, and a slot 50 providing a means to remove the liner 60 from the case 10 without transferring clippings 80 to the case 10 bottom 20.

While the preferred embodiment of the present invention has been described, additional variations and modifications in that embodiment may occur to those skilled in the art once they learn of the basic inventive concepts. Therefore, it is intended that the appended claims shall be construed to include both the preferred embodiment and all such variations and modifications as fall within the spirit and scope of the invention.

I claim:

1. A barber's case comprising: a bottom, a perimeter wall extending upwardly from the bottom; the perimeter wall comprising a first end wall portion, an opposite second end wall portion, and at least one connecting portion having at least one upstanding divider depending inwardly from the connecting portion, the divider and the end wall portions in spaced apart relation defining a plurality of cavities therein; at least one slot defined through the perimeter wall and adjacent the bottom; the at least one upstanding divider disposed adjacent the bottom and having a divider slot therebetween, and in parallel relation to the perimeter wall having the at least one slot; a removable liner disposed on the bottom; the slot adapted to receive the liner within the cavity.

2. A barber's case comprising: a bottom, a perimeter wall extending upwardly from the bottom; the perimeter wall comprising a first end wall portion, an opposite second end wall portion, and at least one connecting portion having at least one upstanding divider depending inwardly from the connecting portion; the first end wall portion having a first slot defined therethrough and the opposite second end wall portion having a second slot defined therethrough; the first end wall portion and second end wall portion comprising a plurality of oppositely disposed connecting portion pairs; a plurality of cavities defined by the bottom and a plurality of dividers in spaced apart relation wherein each individual one of the dividers depends from an individual one of the connecting portion pairs; the plurality of dividers in parallel relation to the first slot and the second slot and further extend downwardly toward the bottom; each divider further comprising a lower portion adjacent the bottom, the lower portion and the bottom defining a divider slot therebetween in each divider so that the divider slots are in parallel relation to the first slot and the second slot; a removable liner disposed on the bottom; the divider slots further adapted to receive the liner.

3. A barber's case comprising: at least one cavity defined by a bottom, a perimeter wall extending upwardly from the bottom, the perimeter wall comprising at least one connecting portion and at least one end wall portion; at least one upstanding divider depending inwardly from the connecting portion and having a divider slot adjacent the bottom; the divider and the end wall portion in spaced apart relation defining a cavity therein; at least one slot defined through the perimeter wall coaxially aligned with the divider slot and adjacent the bottom; a removable liner disposed on the bottom; the slot and divider slot adapted to receive the liner within the cavity.

* * * * *